United States Patent [19]

Thorne

[11] 4,220,421

[45] Sep. 2, 1980

[54] SUBSEA WELLHEAD PROTECTIVE ENCLOSURE

[75] Inventor: Paul M. Thorne, Santa Barbara, Calif.

[73] Assignee: FMC Corporation, San Jose, Calif.

[21] Appl. No.: 963,730

[22] Filed: Nov. 27, 1978

[51] Int. Cl.[2] ..... E02D 31/00

[52] U.S. Cl. ..... 405/211; 166/368; 405/222

[58] Field of Search ..... 405/11, 18, 60, 195, 405/210, 211, 222–226; 166/364, 368; 264/32

[56] References Cited

U.S. PATENT DOCUMENTS

| | | | |
|---|---|---|---|
| 3,247,672 | 4/1966 | Johnson | 405/210 |
| 3,461,957 | 8/1969 | West . | |
| 3,486,341 | 12/1969 | Huesker-Stiewe et al. | 405/18 |
| 3,543,846 | 12/1970 | Smith et al. | |
| 3,661,204 | 5/1972 | Blanding et al. | |
| 3,664,136 | 5/1972 | Laval et al. | 405/60 |
| 3,703,207 | 11/1972 | Horton . | |
| 3,786,640 | 1/1974 | Turzillo | 405/18 |
| 3,910,056 | 10/1975 | Dopyera | 405/211 |
| 3,981,154 | 9/1976 | Hix | 405/60 |
| 4,081,970 | 4/1978 | Dowse | 405/204 |

*Primary Examiner*—David H. Corbin

*Attorney, Agent, or Firm*—Lloyd B. Guernsey; W. W. Ritt, Jr.

[57] ABSTRACT

Method and apparatus for protecting subsea wellheads and christmas trees from damage by anchors, fishing nets, trawl boards, and other towed devices. The apparatus includes an annular, rigid protective enclosure with inner and outer walls that define a hollow annular chamber, and a plurality of bag-like containers spaced around and attached to the enclosure's outer wall. The annular chamber is in communication with the interiors of the containers by means of ports through the enclosure's outer wall, whereby when cement is pumped into the chamber it also flows into and fills the containers to form a smoothly contoured shield around the enclosure. Should an anchor or other device become fouled on this shield, the container or containers involved will break away and let the anchor continue on its way up and over the enclosure without damage to the wellhead or other well equipment.

11 Claims, 6 Drawing Figures

FIG_3
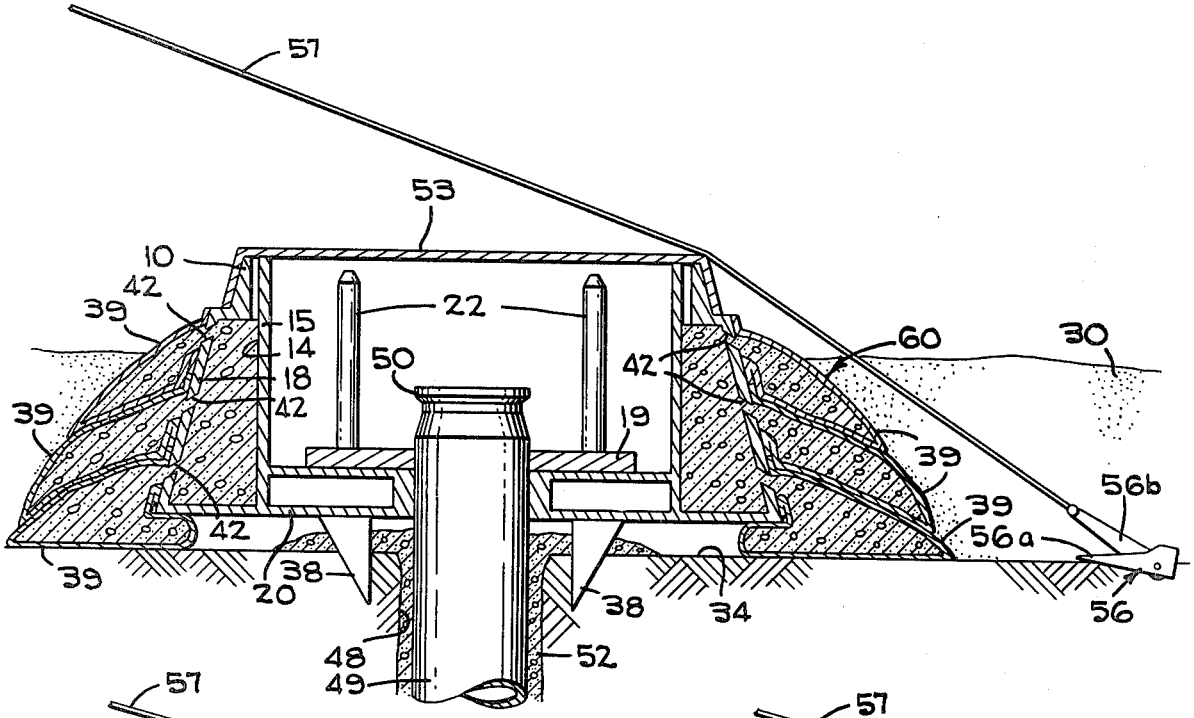
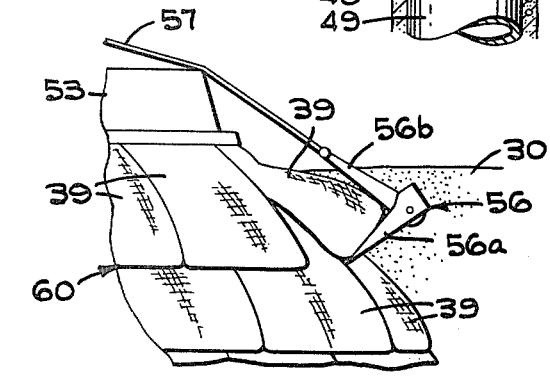
FIG_5
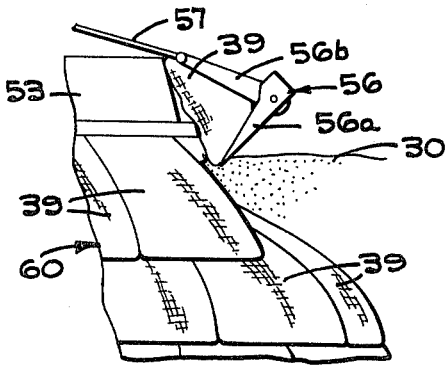
FIG_6
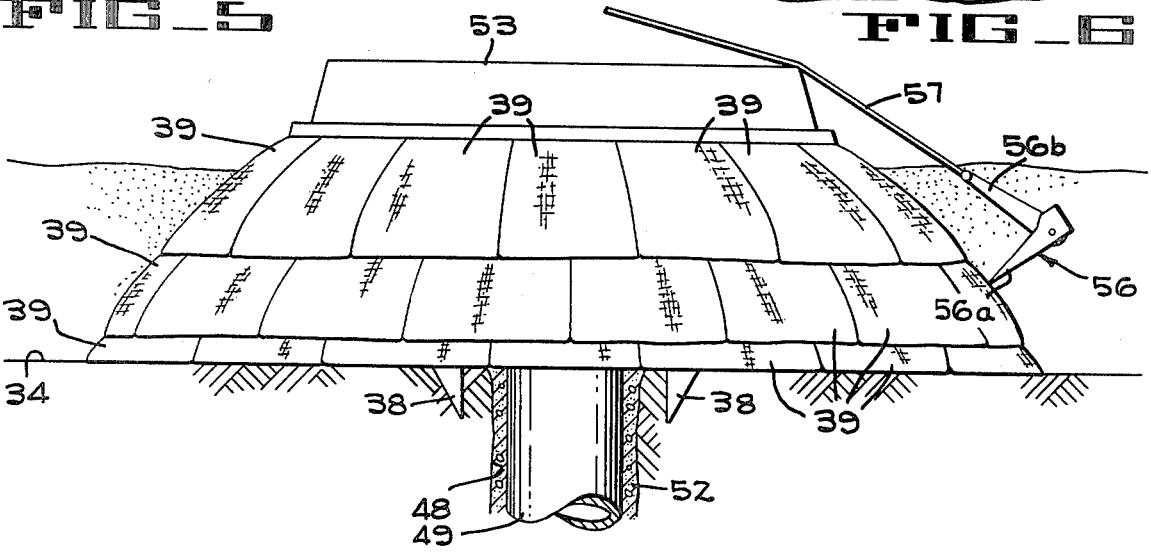
FIG_4

SUBSEA WELLHEAD PROTECTIVE ENCLOSURE

BACKGROUND OF THE INVENTION

1. Field of the Invention

This invention relates to methods and apparatus for protecting subsea well structures, and more particularly to methods and apparatus for preventing damage to these structures by anchors, fishing trawler boards and nets, and other towed objects that could be brought into contact with said structures.

2. Description of the Prior Art

The production of oil and gas from offshore wells has developed into a major endeavor of the petroleum industry. Such wells are now being drilled throughout the world at many locations, some of which are in commercial fishing areas such as the North Sea where anchors, nets, trawl boards and other equipment being towed underwater may come into contact with wellheads and the christmas trees attached thereto. An anchor or trawl board can literally tear a christmas tree or wellhead off the well, thereby causing oil and/or gas leakage into the sea. Such leaks can be dangerous, they always are expensive in terms of repair costs and wasted products, and they also can cause considerable damage to the environment. As a result, several governments now require that subsea christmas trees and other submerged wellhead equipment be protected from these problems.

The prior art describes structures of concrete, steel and/or fiberglass that are simply lowered into place over the subsea christmas tree or wellhead. These structures may be in the form of domes or pyramids, or have a cone-like shape that allegedly encourages deflection of trawl boards and other objects as they encounter these obstructions. Since the christmas tree of a subsea well can protrude 20 to 30 feet above the sea floor, protective structures such as steel or concrete domes or pyramids may be as tall as 30 feet with bases as large as 50 to 60 feet in diameter. As the total weight of these structures may approach or exceed 200,000 lbs., this weight is relied upon to retain them in position. The lighter fiberglass structures require some means of anchoring them to the sea floor, and in some of the prior art installations this has been accomplished with screw-type anchors positioned around their perimeter. In all cases the physical size of each of these prior art structures makes their handling and installation difficult. Furthermore, if an anchor or other device under tow gets a good grip on the structure, as by getting between the bottom of the structure and the solid floor of the sea, the structure can be torn off the well and the wellhead and/or tree severely damaged or destroyed, a result that can readily occur.

SUMMARY OF THE INVENTION

The present invention comprises an annular protective enclosure having an opening in the upper portion thereof to provide access to the well when the enclosure is in place around the well, and with at least one hollow chamber for receiving cement or other desired material. A plurality of empty bags or bag-like containers are attached to the outer wall of the enclosure and means are provided for pumping the cement into the enclosure's chamber and the bags after the enclosure is in position surrounding the well. The filled bags are shaped to form a smoothly contoured shield around the enclosure, but if anchors or other marine equipment become fouled on this shield the bags can break away and allow the marine equipment to continue moving over or around the enclosure without damage to it or the protected wellhead or tree.

BRIEF DESCRIPTION OF THE DRAWINGS

FIG. 3 is a view similar to FIG. 2, showing the enclosure and the bags completely filled with cement, and illustrating how an anchor line will be deflected by the enclosure to lift the anchor flukes out of the sea floor.

FIG. 4 is a side elevation of the enclosure of FIG. 3, showing how the anchor can ride up over the cement shield.

FIG. 5 is a fragmentary view illustrating how a cement filled bag will break away from the enclosure if snagged by an anchor.

FIG. 6 is a view like FIG. 5 showing how the detached bag will catch in the anchor and prevent it from becoming fouled on another part of the shield or enclosure.

DESCRIPTION OF THE PREFERRED EMBODIMENT

Figure 1:
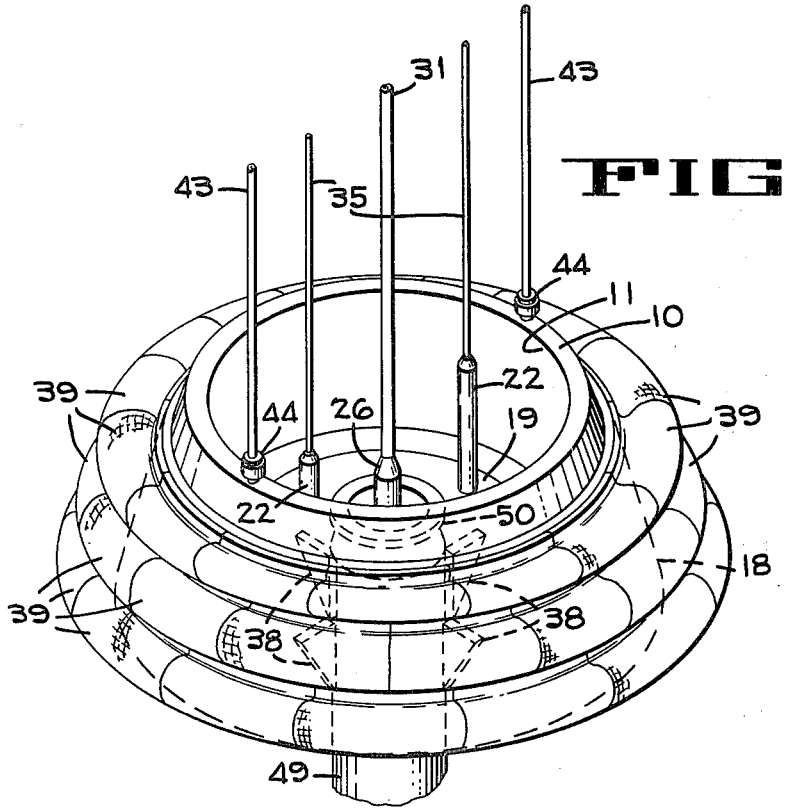
FIG. 1 is an isometric view of an enclosure for protecting subsea wellheads according to the present invention, showing it releasably connected to a pipe string for lowering it to the sea floor.

An apparatus for protecting subsea wells in accordance with the present invention comprises an annular protective enclosure 10 with a large open top 11 to allow access to the well, and chamber 14 which can be a single annular chamber or a plurality of chambers, with an inner wall 15, a sloping outer wall 18, and a bottom wall 20. To the enclosure 10 is welded or otherwise secured a guide base 19 that includes a plurality of vertical guide posts 22, and a conductor pipe 49 surmounted by a wellhead 50.

Figure 2:
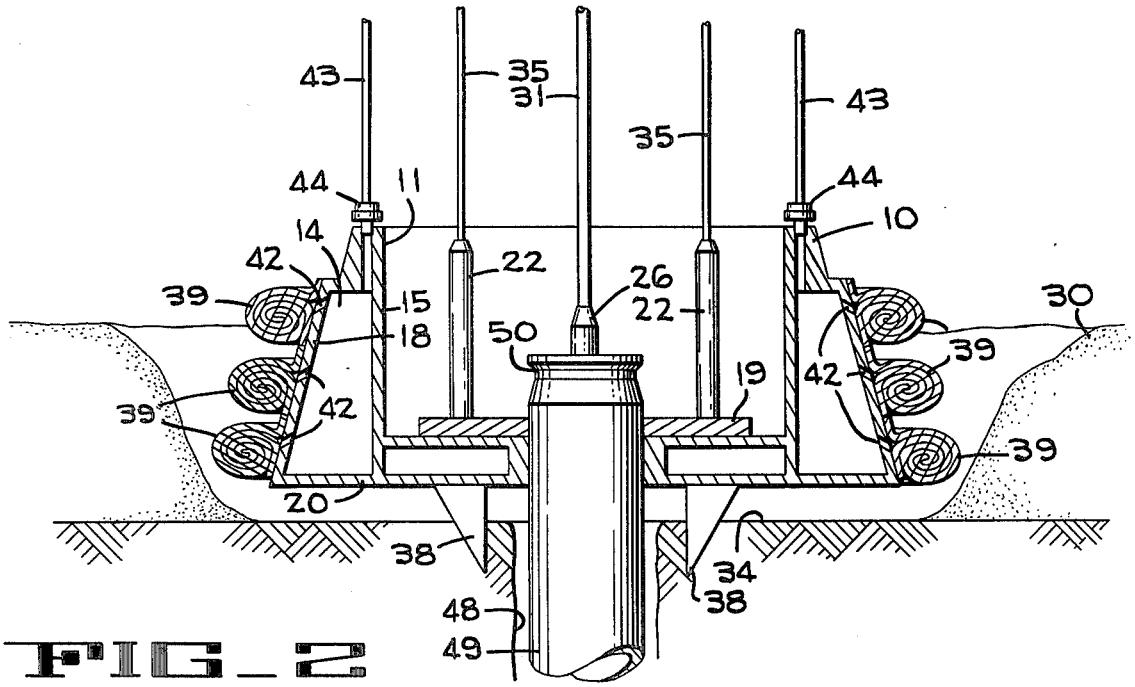
FIG. 2 is a central vertical section through the protective enclosure of FIG. 1, showing it in position around a subsea wellhead, and ready for filling with cement.

A running string 31, attached to the upper end of a running tool 26 that is releasably secured to the wellhead, and thus the guide base 19 and enclosure 10, by a dog and groove arrangement (not shown) or any other suitable means well-known in this industry, is used to lower the wellhead 50, conductor pipe 49, guide base 19 and the protective enclosure 10 as a unit into position on the solid sea floor 34 (FIG. 2). When, as is usually the case, this sea floor 34 is covered by a layer of mud or silt 30, this layer is jetted or otherwise removed from the vicinity of the well by conventional means and the conductor pipe 49 is jetted and/or drilled into the sea floor until the enclosure 10 reaches the position shown in FIG. 2. From this position a plurality of guide lines 35, each connected to one of the guide posts 22, extend to a drilling platform or vessel (not shown) at the surface to guide tools and equipment between the platform or vessel and the guide base 19 in the usual manner. The guide base 19 also includes a plurality of pointed plates 38 that stab into the sea floor 34 to assist in holding the base etc., in proper position.

Surrounding the enclosure 10 and attached to its outer wall 18 are a plurality of bags or bag-like containers 39. A plurality of spaced ports 42 (FIGS. 2 and 3) through the outer wall 18 provide communication between the interior of the bags 39 and the enclosure's chamber 14. Also in communication with the chamber 14, and thus with the bags 39, are a plurality of spaced hoses, pipes, or other tubular conduits 43 that extend between the enclosure 14 and a source of cement, such as the drilling platform or vessel (not shown). The conduits 43 preferably are releasably connected to the enclosure 10 by quick release couplings 44 so that they can be removed when their function has been fulfilled.

Once the enclosure 10 and the guide base 19 have been positioned on the sea floor 34, and the conductor pipe 49 has been cemented to the borehole 48 by pumping cement 52 down the pipe and up the space between it and the borehole to secure the pipe in place, cement is then pumped through the conduits 43 into the chamber 14 from which it flows through the ports 42 into the bags 39, filling the bags and causing them to expand into the shape shown in FIGS. 3 and 4. The bags 39 are shaped to provide a smoothly contoured concrete shield 60 around the enclosure 10 when they are filled with cement, thereby reducing the possibility that anchors and other marine equipment under tow will become fouled as they come into contact with the shield. Should such fouling occur, however, the bag or bags 39 that are snagged will break away from the shield 60 and let the anchor, etc., proceed on its way up and over, or around, the shield and enclosure so that no damage is incurred by the enclosure or the wellhead.

After the chamber 14 and the bags 39 are filled with cement, the cement conduits 43 are disconnected from the enclosure 10 and retrieved to the surface, and a cap 53 (FIG. 3) is lowered and guided into position on top of the enclosure 10 by the guide lines 35. The guide lines 35 can then be disconnected from the guide posts 22 in the usual manner.

FIGS. 3–6 illustrate the manner in which the cement-filled bags break away from the shield 60 as they are snagged by moving marine equipment, thereby protecting the subsea wellhead. As an anchor 56, being pulled along the sea floor 34 by an anchor chain 57, approaches the enclosure 10 the chain 57 contacts the cap 53 (FIG. 3) causing the anchor shank and flukes to be lifted from the sea floor. As the anchor then makes contact with the cement-filled bags 39 (FIG. 4) their smooth contour prevents small anchors from fouling on their outer surface and allows these small anchors to ride up the shield 60 in response to continued pulling by the anchor chain 57. However, when the anchor or other marine equipment is large and/or heavy, and if a bag or bags 39 is/are snagged by such an anchor, etc., as shown in FIG. 5 the bag or bags will break away from the shield 60. Should an anchor be involved, the dislodged bag or bags will jam into the area between the anchor shank 56*b* and flukes 56*a*, thereby preventing further fouling of the anchor on the shield or enclosure and facilitating its continued movement over or around and past the enclosure without damage to it or the protected well equipment.

The cement contained in the chamber or chambers 14, and in the bags 39, advantageously increase the overall weight of the protective enclosure 10 and aid in anchoring it in place, yet this added weight does not have to be supported by the running string 31 since it is pumped or conducted into position after the enclosure 10 has been run and installed. Thus, a considerable savings in equipment costs, by not having to employ special and heavier running apparatus, also is achieved by the present invention.

Although the drawings illustrate only a wellhead within the protected environment of the enclosure 10, it should be clearly understood that the enclosure also can be constructed to adequately protect a christmas tree, whether the tree extends above the wellhead whereby the enclosure will have a much taller profile, or whether a subsurface tree that is located below the sea floor 34 is being protected.

Although the best mode contemplated for carrying out the present invention has been herein shown and described, it will be apparent that modification and variation may be made without departing from what is regarded to be the subject matter of the invention.

I claim:

1. Apparatus for protecting subsea structures on the floor of a body of water from physical damage, said apparatus comprising:
   - a protective enclosure for mounting around said subsea structure;
   - a plurality of containers;
   - means for separately attaching each of said containers to the outside of said protective enclosure, said separate containers being capable of being broken away from said enclosure when subsea marine equipment snags on said containers to reduce the impact moving marine equipment would exert on said protective enclosure; and
   - means for filling said containers with cement.

2. Apparatus as defined in claim 1 wherein said means for filling said containers includes a conduit extending between said containers and a source of cement.

3. Apparatus as defined in claim 1 wherein said containers comprise bags shaped to form a smooth continuous contour around said protective enclosure to reduce the chances of moving marine equipment snagging on said enclosure.

4. Apparatus as defined in claim 1 wherein said protective enclosure includes an inner wall, an outer wall, and an annular chamber therebetween, ports in said outer wall between said chamber and each of said containers, and means for introducing cement into said chamber and said containers.

5. Apparatus for protecting structures on the sea floor from physical damage caused by nets, anchors and other marine equipment, said apparatus comprising:
   - a rigid protective enclosure having a hollow wall;
   - a plurality of bag-like containers;
   - means for separately attaching each of said bag-like containers to the outside of said wall of said enclosure, said separate containers being capable of being broken away from said enclosure when subsea marine equipment snags on said containers to reduce the impact moving marine equipment would exert on said protective enclosure; and
   - means for filling said hollow wall and said bag-like containers with cement.

6. Apparatus as defined in claim 5 wherein said protective enclosure includes a plurality of ports between the interior of said hollow wall and each of said bag-like containers, and means for filling said hollow wall interior and said bag-like containers with cement.

7. Apparatus as defined in claim 5 including a cement conduit connected between said protective enclosure and a source of cement at the water surface.

8. Apparatus as defined in claim 5, wherein said bag-like containers are shaped to form a smooth contour around said protective enclosure when filled with cement, said smooth contour reducing the possibility of subsea marine equipment snagging on said bag-like containers and reducing the amount of impact a moving anchor and other marine equipment would exert on said protective enclosure.

9. Apparatus as defined in claim 5, wherein said protective enclosure is annular in configuration with an inner wall, an outer wall, and an annular chamber between said inner and said outer walls, said outer wall has at least one port between said chamber and each of said bag-like containers, and means for pumping cement into said chamber whereby a portion of said cement flows from said chamber into said bag-like containers.

10. A method of protecting subsea structures on the floor of a body of water from physical damage caused by moving nets, anchors and other marine equipment, said method including the steps of:

(1) acquiring a rigid protective enclosure to mount around said subsea structure, (2) covering at least a portion of the outside wall of said protective enclosure with a plurality of individual bag-like containers each separately attached to said wall, said separate containers each being removable from said wall by a predetermined amount of force, (3) moving said protective enclosure and said bag-like containers into a protective position around said subsea structure, and (4) filling said bag-like containers with cement.

11. Apparatus for protecting structures on the sea floor from physical damage caused by nets, anchors and other marine equipment, said apparatus comprising:

an annular protective enclosure having an inner wall, an outer wall, and an annular chamber between said inner and said outer walls;

a plurality of bag-like containers;

means for separately attaching each of said bag-like containers to said outer wall with said containers arranged in vertical rows, said outer wall having at least one port between said chamber and each of said bag-like containers;

means for pumping cement into said chamber whereby a portion of said cement flows from said chamber into said bag-like containers, said containers being shaped to form a smooth contour around said protective enclosure when said containers are filled with cement, said smooth contour reducing the possibility of subsea marine equipment snagging on said bag-like containers and reducing the amount of impact moving marine equipment would exert on said protective enclosure, said separate containers being capable of being broken away from said enclosure when subsea marine equipment snags on said containers to reduce the impact the moving marine equipment would exert on said protective enclosure.

* * * * *